United States Patent [19]

Charboneau

[11] Patent Number: 4,469,923

[45] Date of Patent: Sep. 4, 1984

[54] PRESSURE RESPONSIVE SWITCH WITH DISCRETE PRESSURE RESPONSIVE UNIT

[75] Inventor: Thomas J. Charboneau, Norton, Mass.

[73] Assignee: Texas Instruments Incorporated, Dallas, Tex.

[21] Appl. No.: 448,668

[22] Filed: Dec. 10, 1982

[51] Int. Cl.[3] ..... H01H 35/34

[52] U.S. Cl. ..... 200/83 P; 200/83 B; 200/83 Y

[58] Field of Search ..... 200/81 R, 83 R, 83 A, 200/83 B, 83 J, 83 P, 83 Q, 83 S, 83 SA, 83 T, 83 V, 83 Y

[56] References Cited

U.S. PATENT DOCUMENTS

| | | | |
|---|---|---|---|
| 3,564,977 | 2/1971 | Davis | 200/83 Y X |
| 3,720,090 | 3/1973 | Halpert et al. | 73/4 R |
| 4,091,249 | 5/1978 | Huffman | 200/83 P |
| 4,220,836 | 9/1980 | Hersey | 200/83 P |
| 4,287,780 | 9/1981 | Poling | 200/83 P |
| 4,330,695 | 5/1982 | Poling | 200/83 P |
| 4,342,887 | 8/1982 | Sanford | 200/83 P |

*Primary Examiner*—J. R. Scott

*Attorney, Agent, or Firm*—James P. McAndrews; John A. Haug; Melvin Sharp

[57] ABSTRACT

A relatively low cost, high performance pressure responsive switch device comprises a base, switch means mounted on the base, and a discrete pressure-responsive unit which is separately testable for predetermining its pressure response characteristics and which is then mounted on the base for moving the switch means between selected switch positions in response to the application of a selected fluid pressure. The discrete pressure-responsive unit is particularly adapted for achieving long unit cycle life under high operating pressure conditions and for actuating the switch means incorporated in the device to achieve long cycle life as well.

13 Claims, 2 Drawing Figures

PRESSURE RESPONSIVE SWITCH WITH DISCRETE PRESSURE RESPONSIVE UNIT

BACKGROUND OF THE INVENTION

The field of this invention is that of pressure-responsive switches and the invention relates more particularly to pressure responsive switches which are adapted to be manufactured at low cost for use in various applications where high performance characteristics are required.

Pressure responsive switches conventionally incorporate a diaphragm which is exposed to fluid pressures in a zone to be monitored so that the diaphragm moves in response to applied fluid pressures. The diaphragm is typically arranged to actuate an electrical switch or the like when an applied fluid pressure reaches a selected level. In many applications, such switches primarily serve a safety function for discontinuing operation of a compressor motor or the like if fluid pressure in the zone exceeds a safe level. Accordingly, the switches have a long service life but are required to undergo only a limited number of operating cycles during that service life. In such conventional applications the pressure switches also tend to be subjected to relatively low operating pressure levels. Accordingly, the performance requirements for such switches are relatively easy to meet. More recently however, some pressure responsive switches have been used in applications where they are intended to perform repetitive control functions rather than protective functions and are therefore required to perform accurately over a very large number of operating cycles. In some of those new switch applications, the switches are subjected to very high operating pressures in normal operation of the switches and have to be capable of withstanding even much greater pressures under certain over pressure conditions without loss of accuracy or device function. Pressure switches adapted to meet these more stringent performance requirements have tended to be much more expensive to manufacture and it has typically been found that switches as manufactured are subjected to relatively high rejection rates when tested for meeting desired performance specifications.

SUMMARY OF THE INVENTION

It is an object of this invention to provide a novel and improved pressure responsive switch; to provide such a switch which is capable of providing a very long cycle life during use under very high operating pressures; to provide such a switch which is capable of withstanding even higher overpressure conditions without loss of function; and to provide such an improved switch which of is simple, rugged and economical construction, which is reliable and accurate in use, and which is adapted to be reliably manufactured and assembled at reasonable cost.

Briefly described, the novel and improved pressure switch of this invention comprises base means, control switch means mounted on the base means to be movable between first and second control positions, and a discrete pressure responsive unit which is separately testable for determining its pressure response characteristics and which is mounted on the base means after testing for moving the control means between selected control positions in response to the application of selected fluid pressures to the unit. The separately testable pressure-responsive unit incorporates features permitting long reliable cycle life under high operating pressure conditions and includes snap acting means for actuating the control switch means or the like in a manner which achieves long cycle life and reliable high performance properties for the switch means. The pressure unit and other components of the switch device are characterized by relatively low manufacturing and assembly costs.

In accordance with this invention, the pressure-responsive unit comprises a support plate having an opening and having a diaphragm formed for example by a superimposed pair of polyimide films or the like arranged on the plate to extend over the support opening. An annular gasket or the like is disposed on one side of the diaphragm opposite the support to be concentric with and to closely surround the support opening. A metal port body bears against the gasket to form a sealed pressure chamber against one side of the diaphragm. The pressure chamber has a diameter only slightly larger than the diameter of the support opening for limiting the pressure forces applied to the device components. Preferably the port body has a recess in one end fitted over the gasket so that the recess bottom bears against the gasket to form the sealed pressure chamber and the body has an integral connector means defining a passage communicating with the recess for connecting the chamber to a pressure zone to be monitored. The recess side wall engages the outer diameter of the annular gasket to support the gasket against lateral blow-out and to prevent expansion of the size of the pressure chamber, and the body has an integral clamping ring which extends around the recess to bear against the diaphragm for securing the diaphragm in place on the support. In that way, the pressure chamber is adapted to handle very high operating pressures over a long service life.

In accordance with this invention, a dished disc element of the type adapted to move from an original dished configuration to an inverted dished configuration with snap action is disposed at the opposite side of the diaphragm and a force converter member is disposed between the dished element and the diaphragm. The force converter has a force receiving portion of a selected diameter movable in the support opening to be responsive to movement of the diaphragm and has a force applying portion of relatively greater diameter bearing against a corresponding diameter of the dished disc element for transmitting the diaphragm movement to the element. In accordance with the invention, the force receiving part of the converter has a diameter only slightly smaller than the support opening so that it slides closely within the opening and provides support for the diaphragm across substantially the full expanse of the support opening when fluid pressure is applied to the diaphragm in the noted pressure chamber. Preferably marginal portions of the force receiving part of the converter and corresponding portions of the support around the margin of the support opening are tapered to avoid injury to the diaphragm when high fluid pressure is applied to the diaphragm. In that way, the diaphragm is of low cost and is easily assembled but is adapted to serve a long cycle life and to withstand high operating pressures.

A reaction means having an annular reaction portion of a different diameter than the force applying portion of the force converter is arranged to bear against a corresponding diameter on the opposite side of the dished disc element for permitting the dished element to move to its inverted dished configuration with snap action when a selected fluid pressure is applied to the diaphragm in the pressure chamber of the switch. Means mount the support plate, diaphragm, gasket and port body as well as the force converter, disc element and reaction means in fixed relation to each other to form a discrete pressure sensing unit and to provide that discrete unit with desired, separately testable pressure response characteristics. Preferably the mounting means comprises a deformable, metal sleeve which encloses the force converter and dished disc element and which extends around the support plate and diaphragm and the clamping ring portion of the port body. An integral inturned flange at one end of the sleeve has the annular reaction means formed therein to bear against the disc element and has a central opening receiving the motion transmitting means to be engaged by the disc element. Preferably the force converter has a stop ring which fits around the disc element and is adapted to engage the reaction means after the disc has snapped to its inverted dished configuration, thereby to shield the disc element from the effects of any greater overpressure conditions which the switch may encounter. A shoulder is formed in the sleeve intermediate the sleeve ends for receiving and positioning the support plate, and an integral inturned flange at the opposite end of the sleeve bears against the clamping ring of the port body for securing the components of the discrete pressure unit together.

In a preferred embodiment of the invention, the base means comprises a cup-shaped housing having a flange around an open end of the housing and the switch means are of any conventional type and are disposed within the housing. The discrete pressure sensing unit of this invention is tested for verifying that it has desired performance characteristics and is then disposed on the housing flange with a motion transfer pin of selected size disposed between the disc element of the pressure unit and the switch means for actuating the switch means in response to fluid pressures detected by the pressure unit. A sleeve fits over the sensor unit and the housing flange and serves to mount the unit on the housing in fixed relation to the switch means.

In that arrangement, the pressure responsive switch device of this invention incorporates base means, switch means, motion transmitting means, and pressure sensing means which are each of low cost, high performance construction and which are easily and reliably assembled to form a reliable pressure switch device. The discrete pressure responsive unit is particularly adapted to operate for a long cycle life under high operating conditions and is separately testable to assure it has the proper pressure response characteristics before assembly with the other components of the switch device. The pressure unit also cooperates with the switch means to provide the switch means with a corresponding long cycle life and high performance properties.

DESCRIPTION OF THE DRAWINGS

Other objects, advantages and details of the novel and improved pressure switch device of this invention appear in the following detailed description of preferred embodiments of the invention, the detailed description referring to the drawing in which.

DESCRIPTION OF PREFERRED EMBODIMENTS

Figure 1:
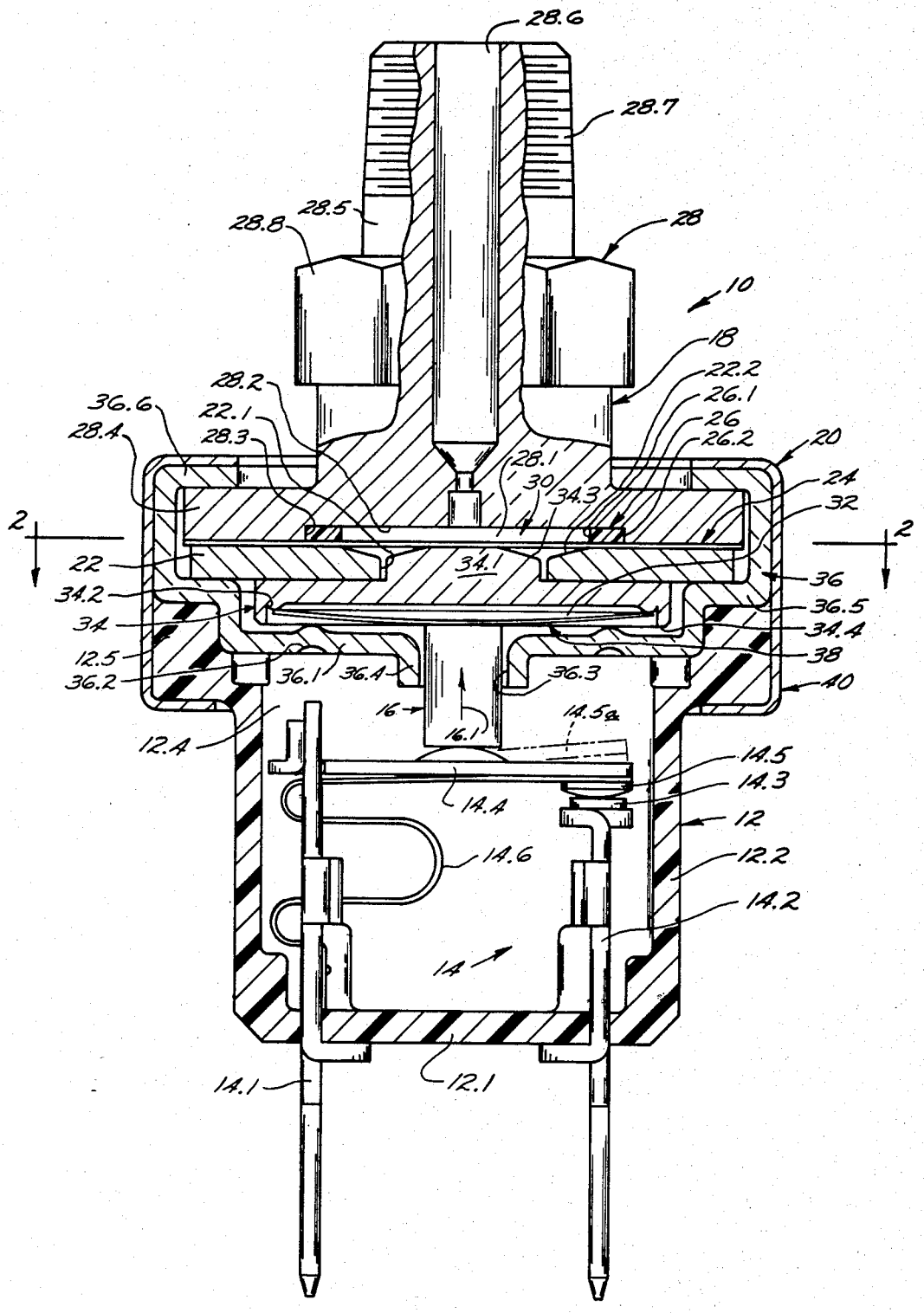
FIG. 1 is a section view to enlarged scale along the longitudinal axis of the pressure switch device of this invention.

Referring to the drawing, 10 in FIG. 1 indicates the novel and improved pressure switch device of this invention which is shown to include a base or housing means 12, control switch means 14 or the like mounted on the base means to be movable between selected control positions, motion transmitting means 16, a discrete pressure-responsive unit 18 having separately testable pressure response characteristics, and means 20 for mounting the discrete pressure-responsive unit on the base means to move the motion transmitting means for moving the control means between selected control positions in response to application of selected fluid pressure to the pressure sensing unit 18.

In a preferred embodiment of the invention, the base means 12 comprises a generally cup-shaped and generally cylindrical housing having a bottom 12.1, having a side wall 12.2, having a housing chamber 12.3, having an open end 12.4, and having a mounting flange 12.5 extending around the open end of the housing. The housing is preferably formed of a strong and rigid electrically insulating material such as a phenolic resin or the like. Any other conventional base means are also used within the scope of the invention.

The control means 14 are preferably mounted on the housing means within the housing chamber and in accordance with the invention, the control means 14 is of any conventional type. Preferably for example the control means comprises an electrical switch means having a pair of terminal means 14.1 and 14.2 mounted in the housing bottom to extend out of the housing from within the housing chamber, has a stationary contact 14.3 mounted on one of the terminal means, has a movable contact arm 14.4 pivotable on the other terminal means 14.1, has a movable contact 14.5 carried by the arm to be movable between a first, closed circuit switch position as indicated in solid lines in FIG. 1 and a second, open circuit position as indicated by broken lines **14.5*a* in FIG. 1, and has spring means 14.6 electrically connected between the terminal means 14.1 and the movable arm 14.4 for normally biasing the movable contact 14.5 to disengage the stationary contact 14.3 as will be understood. In a preferred embodiment, the switch means 14 comprises a highly reliable, easily assembled and mounted switch means such as is described in a commonly-assigned, copending application Ser. No. 448,106 of the present inventor filed of even date herewith. As various types of switches and control means 14 are adapted to be used in the pressure device of this invention, the switch means is not specifically described herein to any further extent and it will be understood that the switch means is mounted on the base means to be movable between selected switch positions for performing a desired control function or the like. The motion transmitting means 16 preferably comprises a motion transfer pin of a ceramic material or the like. In the described exemplary embodiment of the invention, the pin normally holds the switch arm 14.4 in closed circuit position against the bias of spring 14.6 as shown in FIG. 1 but is axially movable as indicated by the arrow 16.1 in FIG. 1 for permitting the switch arm 14.4 to move to the described open circuit position indicated at 14.5*a* in response to the spring 14.6** as described below.

Figure 2:
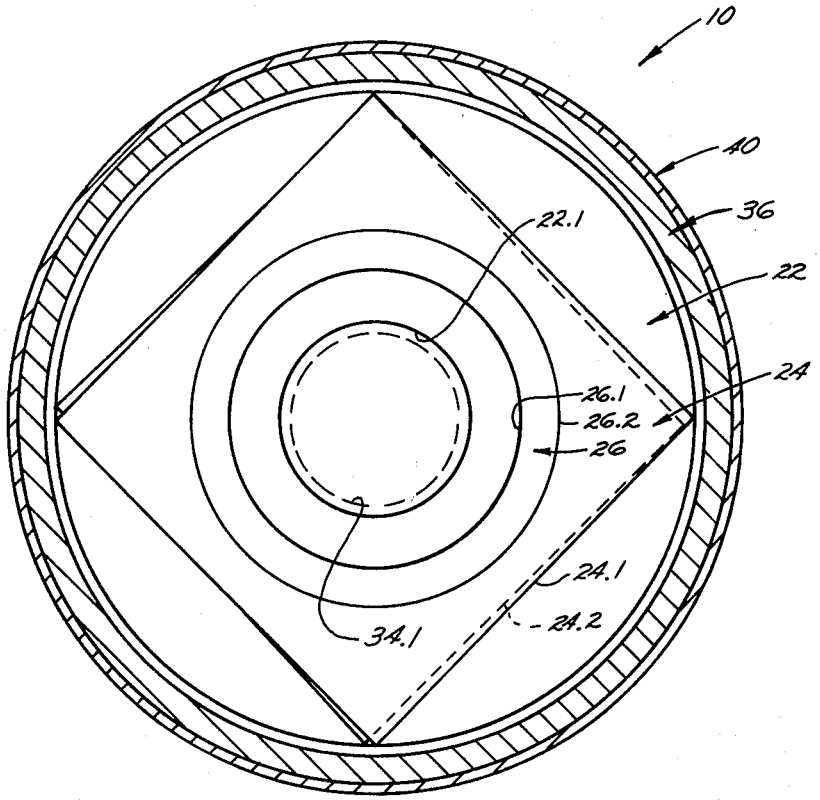
FIG. 2 is a section view along line 2—2 of FIG. 1.

In accordance with this invention, the discrete pressure responsive unit 18 of the invention comprises a support 22 having an opening 22.1 therein. Preferably the support comprises a flat round plate of cold rolled steel or the like having a round central opening 22.1 and having tapered or radiused portions 22.2 formed around the margin of the support opening. A diaphragm 24 is disposed on the support plate to extend over the support opening. Preferably, as is best shown in FIG. 2, the diaphragm comprises a plurality of thin films of a strong, pliable and stiffly flexible polyimide material or the like which is adapted to flex over the support opening 22.1 in response to application of fluid pressures to the diaphragm but which is also adapted to withstand substantial fluid pressure forces without rupture and to be capable of retaining its strength properties at elevated temperatures. The diaphragm is preferably formed of two or more thin polyimide films as sold under the designation Kapton or the like, the films each being of about 0.005 inches in thickness and being superimposed on each other (as indicated at 24.1, 24.2 in FIG. 2 for clarity of illustration) so that the films are adapted to withstand very high applied pressures without rupture but are adapted to flex under such applied pressures with reduced tendency to crack or fatigue. Preferably, to economize on material, the films are cut with square sections as shown in FIG. 2 to use all of the film material without scrap or waste.

A gasket means such as an annular, rubber O-ring type of gasket 26 or the like is mounted on one side of the diaphragm opposite the support 22 to be concentric with the support opening 22.1. A metal port body 28 is mounted to bear against the gasket for forming a sealed pressure chamber 30 in the switch at said one side of the diaphragm. In accordance with the invention, the inner diameter 26.1 of the gasket is only slightly larger than the diameter of the support opening 22.1 so that, when high fluid pressures are introduced into the pressure chamber 30, the forces applied to the support 22 and to the diaphragm 24 by the applied fluid pressures are relatively restricted and do not excessively stress the support plate. In a preferred embodiment of the invention, the port body has a recess 28.1 in one end of the body fitted around the gasket so that the bottom of the body recess 28.2 bears against the gasket, so that the side wall 28.3 of the recess engages the outer diameter of the annular gasket to fully support the gasket and prevent either lateral blow-out of the gasket or any lateral expansion of the size of the pressure chamber 30, and so that an integral clamping portion 28.4 of the body is formed around the recess to bear against the full margins of the diaphragm films 24 for retaining the diaphragm in place over the support opening 22.1. The port body is preferably of extruded, one-piece configuration for low cost strength and includes integral connector means 28.5 defining a passage 28.6 which communicates with the recess 28.1 and has thread means 28.7 and hex means 28.8 for use in connecting the chamber 30 through the passage 28.6 to a pressure zone to be monitored in conventional manner.

The pressure responsive unit 18 further comprises a conventional dished or domed metal disc spring element 32 formed of stainless steel or the like adapted to move with snap action from an original dished configuration as shown in FIG. 1 to an inverted dished configuration in response to application of selected force to the element. Preferably the element is adapted to return to its original configuration with snap action when the applied force is reduced to a reset level or is removed. A force converter 34 is disposed between the dished element 32 and the support 22. The converter has a force receiving portion 34.1 of a selected diameter which is movable in the support opening 22.1 to be responsive to movement of the diaphragm 24 and has an annular force applying portion 34.2 of relatively larger diameter which bears against a corresponding diameter portion on one side of the disc element 32 for transmitting the diaphragm movement to the disc as a force tending to move the disc to its inverted dished configuration. In accordance with this invention, the force receiving portion 34.1 of the force converter has a diameter only slightly smaller than the diameter of the support opening 22 and is adapted to slide closely within the opening. Preferably the margins of the force receiving portion are tapered at 34.3. In that arrangement, the force receiving portion of the converter provides support for the diaphragm 24 over substantially the entire expanse of the support opening 22.1 and the margins of the opening and of the force receiving portion are tapered to avoid injury to the diaphragm when very high fluid pressures are applied to the diaphragm in the chamber 30.

In accordance with this invention, the pressure responsive unit 18 further comprises a reaction means having an annular portion thereof of a different diameter than the force applying portion 34.2 of the force converter. The reaction means bears against a corresponding diameter on the opposite side of the dished disc element 32. Means then mount the support plate, and the port body, gasket and diaphragm as well as the force converter, disc and reaction means together in fixed relation to each other to form the discrete unit 18 of this invention. Preferably for example, the mounting means and the reaction means are integrally combined in a metal sleeve 36. An integral inturned flange 36.1 of the sleeve has the annular reaction means 36.2 formed therein by an embossment or the like and has a central opening 36.3 and a guide flange 36.4 arranged to slidably receive the motion transfer pin 16 therein. A shoulder 36.5 is formed on the sleeve intermediate its ends for receiving and positioning the support plate 22. A second integral inturned flange 36.6 at the opposite end of the sleeve bears against the clamping ring portion 28.4 of the port body for compressing the gasket and for securing the components of the pressure sensing unit together to form the discrete, separately testable unit 18 of this invention. Preferably a pliable film 38 of a polyimide material or the like is disposed between the disc 32 and the force converter 34 to serve as a lubricant and prevent galling of the disc during relative movement of the disc and force converter.

In accordance with this invention, the motion transmitting pin 16 is slidably disposed in the opening 36.3 in the pressure unit mounting sleeve, the pressure responsive unit 18 is mounted on the housing flange 12.5 and a second metal sleeve 40 or the like is swaged over the unit 18 and the flange 12.5 for securing the housing, switch means and pressure unit together to form the pressure device 10.

In the arrangement, fluid pressure is adapted to be introduced into the chamber 30 through the port passage 28.6 to be applied to the diaphragm 24 so that the diaphragm flexes over the support opening 22.1 and transmits its flexing movement to the disc element 32 through the force converter 34. When that applied fluid pressure is below a selected level, the disc element remains in the position shown in FIG. 1 and the disc spring holds the pin 16 and the contact arm 14.4 in the position shown in FIG. 1 against the bias of the spring 14.6 so that the switch means 14 remains in closed circuit position. However, the relative diameters of the force receiving and applying portions 34.1, 34.2 of the force converter and the diameter of the annular reaction means 36.2 cooperate in known manner to apply a force to the disc element and that force cooperates with the selected snap-acting characteristics of the element so that the disc moves with snap action to its inverted dished configuration when the applied fluid pressure reaches a selected level. When that occurs, the motion transfer pin 16 moves in the direction of the arrow 16.1 in response to the bias of the switch spring 14.6 and permits the switch arm 14.4 to move to open circuit position. In a preferred embodiment of the invention, the force converter has an annular stop 34.4 of relatively larger diameter than the disc element 32 which fits around the disc and which is adapted to engage the inturned sleeve flange 36.1 after the disc element has moved to its described inverted configuration, thereby to protect the disc element against any excessive overpressures which may be applied to the diaphragm 24. The stop 34.4 is proportioned so that, when the stop is engaged with the flange 36.1, the force receiving portion 34.1 of the force converter is within the support opening 22.1 at a location where it provides substantially full support for the diaphragm to prevent diaphragm rupture even if very great overpressures should be applied to the diaphragm within the chamber 30. When the applied fluid pressure in the chamber 30 is subsequently reduced to a reset level or is removed, the disc element 32 moves with snap action back to its original dished configuration as shown in FIG. 1 and restores the switch arm 14.4 to its closed circuit position.

It can be seen that the pressure device 18 is of simple, low cost construction but is adapted to withstand very high operating pressures while moving the disc 32 to its inverted dished configuration to perform a control function over a long service life in response to the application of precisely predetermined fluid pressure to the diaphragm 24 in the chamber 30. That is, the chamber's size is restricted for reducing forces applied to the device components by the applied high fluid pressures; the diaphragm 24 is substantially fully supported while under initially applied pressures, undergoes a precisely limited degree of flexing in response to increases in pressure to the actuating level of the device, and is thereafter substantially fully supported to prevent diaphragm rupture if substantial overpressures should occur. The multiple films used in forming the diaphragm permit flexing of the diaphragm over a long service life with improved strength and with reduced risk of fatigue cracking or the like and tapering of the support and force converter while those components engage the diaphragm avoids risk of injury to the diaphragm. The components of the pressure unit 18 are easily and accurately assembled by simply dropping the unit components into the sleeve 36 and by swaging the sleeve over the port clamping ring as shown. The switch means 18 are also adapted to be separately tested for achieving desired performance characteristics. Precise matching of the unit 18 to the switch means 14 is easily and economically achieved by proper selection of the length of the pin and, where the pressure responsive unit 18 provides for snap-acting movement of the dished element 32, actuates the switch means 14 in a manner which is adapted to enhance the cycle life of the switch means used in the device 10.

It will be understood that the pressure responsive switch device 10 of this invention is adapted to be modified in various conventional ways within the scope of this invention. For example, the device 10 is also adapted for normally open switch operation; the relative diameters for the force converter and reaction means engaged with the disc element are adapted to be inverted so that the disc element is arranged with the normally convex side of the disc facing upwardly as viewed in FIG. 1; and the snap-acting element 32 is adapted to be formed of a thermally responsive bimetallic material such that the responsive characteristics of the element vary in known manner with temperature. It should be understood that although particular embodiments of the invention have been described by way of illustrating the invention, this invention includes all modifications and equivalents of the disclosed embodiments falling within the scope of the appended claims.

I claim:

1. A pressure-responsive control device comprising base means, control means mounted on the base means and movable between first and second control positions, and snap-acting pressure-responsive means for moving the control means between said control positions in response to the application of a selected fluid pressure, characterized in that the pressure-responsive means is a discrete unit having separately testable pressure response characteristics and means mount the pressure-responsive means on the base means for moving the control means between said control positions in response to application of said selected fluid pressure, the pressure-responsive means comprising a support having an opening therein, diaphragm means disposed on the support and extending over the opening, port means disposed on one side of the diaphragm means in sealed relation to the diaphragm means forming a sealed chamber at said one side of the diaphragm means having a passage communicating with the chamber for exposing said one side of the diaphragm means to a fluid pressure to move the diaphragm means relative to said opening in response to said pressure, snap-acting means including a dished disc element mounted at an opposite side of the diaphragm means to be movable with snap-action between original and inverted dished configurations in response to movement of the diaphragm means when said selected fluid pressure is applied to the diaphragm means for moving the control means between said control positions, and means mounting the support and port and snap-acting means in fixed relation to each other and to the diaphragm means to form said discrete, separately testable pressure-responsive unit.

2. A pressure switch device comprising base means, switch means mounted on the base means and movable between first and second switch positions, snap-acting pressure-responsive means for moving the switch means between said switch positions in response to the application of a selected fluid pressure, characterized in that the pressure-responsive means is a discrete unit having separately testable pressure response characteristics, means mount the pressure-responsive unit on the base means, and motion transmitting means are disposed between the pressure responsive unit and said switch means for moving the switch means between said switch positions in response to application of said selected fluid pressure to the pressure responsive unit, the pressure-responsive unit comprising a support having an opening therein, diaphragm means disposed on the support extending over the opening gasket means having an opening larger than the support opening disposed on a first side of the diaphragm means opposite from the support in concentric relation to the support opening, port means disposed at said first side of the diaphragm means to bear against the gasket means and form a sealed chamber at said first side of the diaphragm means, the port means having a passage communicating with the chamber for exposing said first side of the diaphragm means to a fluid pressure to move the diaphragm means relative to the support opening in response to said pressure, a dished disc element disposed at an opposite side of the diaphragm means to be movable with snap action between original and inverted dished configurations for moving the switch means between said switch positions, force converter means disposed between the disc element and the diaphragm means having a force receiving portion of a first selected diameter disposed in the support opening to be responsive to movement of the diaphragm means and having an annular force applying portion of a second relatively larger diameter bearing against a corresponding diameter on one side of the disc element for transmitting said movement of the diaphragm means to the element, reaction means having a concentric annular reaction portion of a different diameter engaging such a corresponding diameter on an opposite side of the disc element permitting the disc element to move to said inverted dished configuration in response to application of said selected fluid pressure to the diaphragm means, and means mounting the support and disc element and the port, gasket, converter and reaction means in fixed relation to each other and to the diaphragm means to form said discrete, separately testable pressure-responsive unit.

3. A pressure-responsive switch as set forth in claim 2 further characterized in that the support opening has a selected diameter and the gasket means opening is limited to a diameter only slightly larger than the support opening for limiting the force applied to the support by said applied fluid pressure.

4. A pressure responsive switch as set forth in claim 3 further characterized in that the gasket means comprises an annular gasket member having selected inner and outer diameters and the port means comprises a metal body having a recess in one end fitted around the annular gasket member, the recess having a bottom bearing against the gasket member to form said sealed chamber, having a side wall engaging the outer diameter of the gasket member to restrict the outer gasket diameter for limiting the forces applied to the support means by fluid pressure in the chamber, and forming an integral body ring portion around the recess bearing against the diaphragm means for securing marginal portions of the diaphragm means in fixed location relative to the support, the body having an additional integral portion defining said passage for connection to a zone whose fluid pressure is to be monitored.

5. A pressure switch as set forth in claim 3 further characterized in that the diaphragm means comprises a plurality of flexible films of an organic material disposed in superimposed relation to each other on the support and clamped between the support and said integral ring portion of the port means for cooperating in withstanding relatively high applied fluid pressures without rupturing and for permitting flexing of the diaphragm over a long service life.

6. A pressure responsive switch as set forth in claim 5 further characterized in that said films disposed on the support to extend over the support opening between the gasket member and the support are formed of a polyimide material and have a square configuration for enhancing clamping of the films between the support and said integral ring portion of the port means.

7. A pressure responsive switch as set forth in claim 2 further characterized in that said force receiving portion of the force converter means has a diameter substantially corresponding to the diameter of the support opening slidable in the support opening for cooperating with the support in substantially fully supporting the diaphragm means when fluid pressure is applied thereto.

8. A pressure responsive switch as set forth in claim 7 further characterized in that the force converter means has stop means adapted to engage said reaction means after snap acting movement of the disc element to said inverted dished configuration in response to application of fluid pressure to the diaphragm means for protecting the disc element and positively supporting the diaphragm means in the support opening if excessive fluid pressure is applied to the diaphragm means.

9. A pressure responsive switch as set forth in claim 8 further characterized in that the annular force applying portion of the force converter means has a relatively larger diameter than said annular reaction portion of the reaction means and said stop means comprise an annular ring of relatively larger diameter than said force applying portion of the converter means adapted to engage the reaction means around said annular reaction portion thereof.

10. A pressure responsive switch as set forth in claim 8 further characterized in that the force receiving portion of the force converter means is slidable in the support opening and the support around the margin of the support opening has tapered portions to conform to the diaphragm means as fluid pressure is applied to the diaphragm means for reducing risk of injury to the diaphragm means.

11. A pressure responsive switch as set forth in claim 2 further characterized in that said mounting means comprises a metal sleeve integral with said reaction means, said sleeve having an integral inturned flange at one end forming said reaction means and having said annular reaction portion of the reaction means embossed therein, said sleeve enclosing said disc and force converter means and said integral flange portion of the body of the port means, and having an integral inturned flange at the opposite end of the sleeve engaging said flange portion of the port body means to form said discrete, separately testable pressure responsive unit.

12. A pressure switch comprising a base; a switch mounted on the base to move between first and second switch positions; motion transmitting means; and a discrete pressure responsive unit having separately testable pressure response characteristics mounted on the base for moving the motion transmitting means to move the switch between said switch positions in response to application of a selected fluid pressure to the unit; the pressure responsive unit comprising a support plate having an opening of selected diameter; a plurality of flexible polyimide films disposed on the plate in superimposed relation to each other extending over the support opening to form a diaphragm; an annular gasket having a selected inner diameter only slightly larger than the support opening disposed on one side of the diaphragm opposite the support concentric with the support opening; a metal port body having a recess at one end fitted around the gasket and having integral means defining a passage communicating with the recess for connection to a pressure zone to be monitored, the recess having a bottom engaging the gasket to form a sealed pressure chamber at said one diaphragm side, having a side wall engaging an outer diameter of the gasket for limiting the chamber size, and forming an integral ring clamping the diaphragm around the recess to secure the diaphragm in a fixed location; a dished disc element disposed at an opposite side of the diaphragm to be movable with snap action between original and inverted dished configurations; a force converter having a force receiving portion of a first diameter substantially corresponding to the diameter of the support opening slidable in the opening to be movable in response to movement of the diaphragm, having a force applying portion of a second larger diameter engaging one side of the dished disc element for transmitting diaphragm movement to the element, and having a stop of a third larger diameter fitted around the disc element; and a sleeve having a first integral inturned flange at one end having an annular reaction portion of relatively smaller diameter than the force applying portion of the force converter means engaging an opposite side of the dished disc element for permitting the element to move to its inverted dished configuration with snap action when said selected fluid pressure is applied to said one diaphragm side, having an opening therein receiving said motion transmitting means for transmitting said snap acting disc movement to said switch means, and having a portion for thereafter engaging the stop on the force converter for protecting the dished element against excessive pressures applied to the diaphragm, the sleeve having a shoulder formed therein intermediate the sleeve ends for receiving and positioning the support plate relative to the disc and force converter and said first sleeve flange, and the sleeve having a second, integral inturned flange at the opposite end thereof engaging said body clamping ring for securing the clamping ring and diaphragm and said support and gasket to each other to form said discrete pressure responsive unit.

13. A pressure responsive switch as set forth in claim 12 having an organic film element disposed between the disc element and the force converter for protecting the disc element during snap acting movement thereof against the force converter.

* * * * *